United States Patent [19]

Warren

[11] Patent Number: 4,718,874

[45] Date of Patent: Jan. 12, 1988

[54] ROTARY FLIGHT DEVICE

[76] Inventor: Marc R. Warren, 77 Cook Hill Rd., Windsor, Conn. 06095

[21] Appl. No.: 900,703

[22] Filed: Aug. 27, 1986

[51] Int. Cl.[4] ..... A63H 27/12

[52] U.S. Cl. ..... 446/36

[58] Field of Search ..... 446/36, 37, 68; 273/426

[56] References Cited

U.S. PATENT DOCUMENTS 3,722,132 3/1973 Seefluth ..... 446/36

FOREIGN PATENT DOCUMENTS 1161026 3/1958 France ..... 446/36

*Primary Examiner*—Philip C. Kannan

*Attorney, Agent, or Firm*—Victor E. Libert

[57] ABSTRACT

A hand-launched rotary flight device comprising a central hub from which a plurality of preferably equiangularly spaced-apart blades extends. The central hub has a finger grip portion with which the hub is rotatable, which finger grip portion extends radially from a blade-mounting portion of the hub in a direction away from the blades. The finger grip portion is dimensioned and configured to enable manual gripping thereof, ideally between the thumb and forefinger of the operator, to permit launching the device by hand into a rotary motion flight path without necessity of a mechanical launching device.

20 Claims, 15 Drawing Figures

ROTARY FLIGHT DEVICE

FIELD OF THE INVENTION

This invention relates to a novel, hand-launched rotary flight device. In its more specific aspects, this invention relates to a rotary flight toy that is hand-launched by the operator into a free-flight, rotary motion.

BACKGROUND

Numerous free-flight toys have been proposed and marketed, such as propeller wheels, helicopter wheels and boomerangs Some of these toys are launched mechanically and others by hand. For example, U.S. Pat. No. 1,201,866 to Pickett discloses an aerial toy including a propeller having a hub portion in which an axially elongated bushing is secured. This bushing is designed to receive a screw for rotating the propeller, which is rotated by a downward movement of a handle grip until it hits a stop means causing inertial disengagement of the whirling propeller from the launcher. Launching an aerial toy of this type by hand-operated mechanical means has a number of disadvantages in that it is unnecessarily complicated, especially for children, is easily broken or damaged, and can be hazardous. There is a wide variety of boomerang toys which are launched by hand, such as disclosed in U.S. Pat. No. 3,881,729 to Block. Typically, the boomerang is hand-launched by the operator by holding the tip of the boomerang between the thumb and forefinger with an upward and outward arm-throwing movement. The flight path of the boomerang, which if executed properly returns the boomerang to the operator, is achieved solely by a hand-launch of an operator who must grip the device at one of the wing tips.

Another boomerang toy is disclosed in U.S. Pat. No. 3,814,431 to Callahan and includes a vertical hollow handle in which ballast may be placed to control the speed of descent of the device. The patent discloses that hand-launching is achieved by grasping one wing between the fingers and, upon retrieval, the device may be caught by the handle which remains stationary while the wings rotate.

U.S. Pat. No. 3,722,132 discloses a wing toy for toy airplanes, particularly toy helicopters, in which two generally flat members, at least one of which has a curved profile portion, are joined together to provide a lift-imparting profile to the device.

SUMMARY OF THE INVENTION

In accordance with the present invention there is provided a hand-launched rotary flight device comprising: (a) a central hub having an axis of rotation and comprising a finger grip portion; (b) a plurality of spaced-apart blades, e.g., equiangularly spaced-apart blades, joined to the hub at a blade-mounting portion thereof, and extending radially therefrom and terminating in respective blade tips; the hub being rotatable with the finger grip portion, the finger grip portion extending axially from the blade-mounting portion in a direction away from the blades and being dimensioned and configured to enable manual gripping thereof by the operator to impart to the device free-flight and rotary motion about the axis of rotation of the hub.

In accordance with another aspect of the invention there is provided a rotary flight device comprising: (a) a generally disc-shaped central hub having an axis of rotation and comprising a blade-mounting portion; (b) a plurality of equiangularly spaced-apart blades joined to the blade-mounting portion of the hub, extending radially therefrom and terminating in respective blade tips; the hub extending axially from its blade-mounting portion in a direction away from the blades to provide a finger grip portion thereof which is dimensioned and configured to enable manual gripping thereof by an operator to impart to the device free-flight and rotary motion about the axis of rotation of the hub.

Certain aspects of the invention provide one or more of the following features, alone or in combination: the device may comprise three blades extending from the hub; the finger grip portion may have a knurled surface dimensioned and configured to be gripped by the operator between thumb and forefinger and/or may be provided with a recess to accommodate the thumb of the operator; a ballast weight may be carried by the hub; at least the leading edge of each blade may be beveled; the blades may be bent about respective axes transverse to the longitudinal axes of the blades so as to displace the blade tips relative to the hub in the direction from the blade-mounting portion to the grip end portion, e.g., the blades may be bent to define a bend angle up to about 20 degrees, e.g., from about 5 to 20 degrees. The blades may be made of a conformable material, whereby the bowed or bent configuration may be varied or eliminated as desired, to permit selective changes in blade configuration.

Still other aspects of the invention provide for the blade tips to be weighted. Further, in still other aspects of the invention, the blades may be configured to have a positive angle of attack, or a negative angle of attack. Thus, the blades may be configured to have a positive angle of attack in one direction of rotation and a negative angle of attack in the opposite direction of rotation.

DETAILED DESCRIPTION OF THE INVENTION AND PREFERRED EMBODIMENTS

The flight device of this invention may be directly launched by hand into a free-flight, rotary motion after a certain amount of practice by the operator, to provide a challenging, safe and interesting toy. The flight device includes a plurality of spaced-apart blades extending radially from a hub. The blades are propeller-like and joined at one end to the hub, preferably in such a manner as to lay in a common plane.

A finger grip portion is affixed to the hub so that the hub rotates therewith, and extends below the transverse plane of the hub. Preferably the finger grip portion is formed integrally with the hub as a unitary piece. The finger grip portion is dimensioned and configured to enhance the grip thereof by the operator. By proper hand/arm movement including a snap of the wrist, the operator can impart a free-flight, rotary motion to the toy, the flight path of which resembles that of a toy helicopter.

Figure 1:
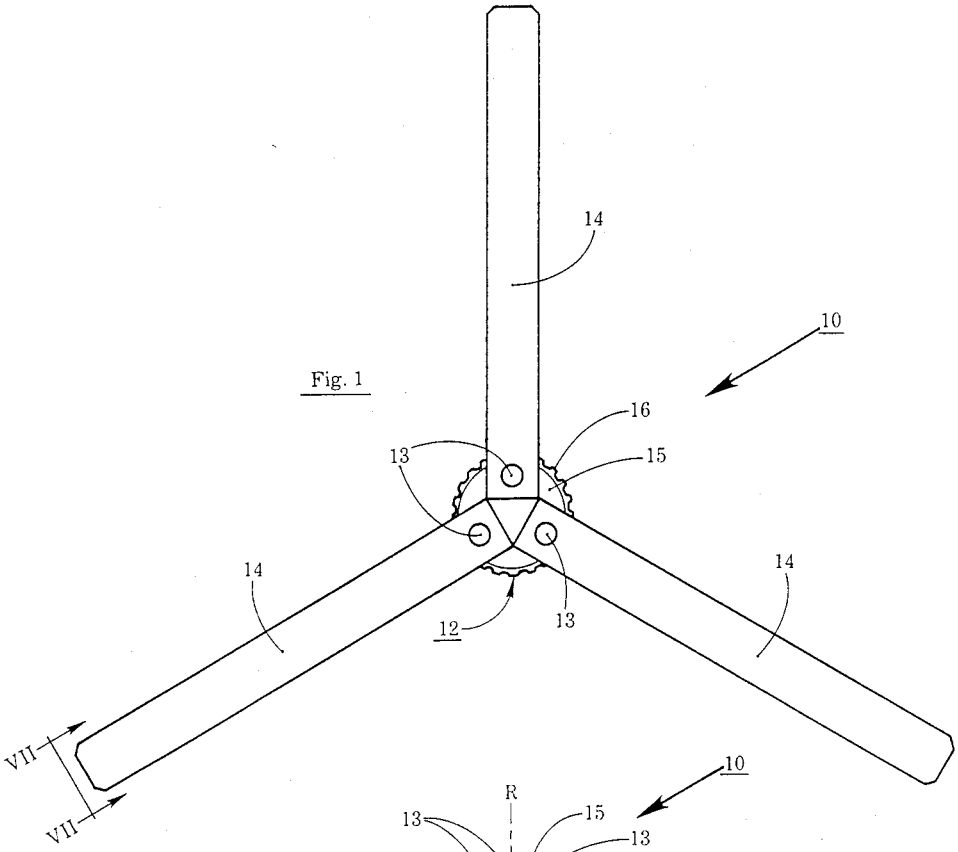
FIG. 1 is a top plan view of a preferred embodiment of a rotary flight device of this invention.
Figure 2:
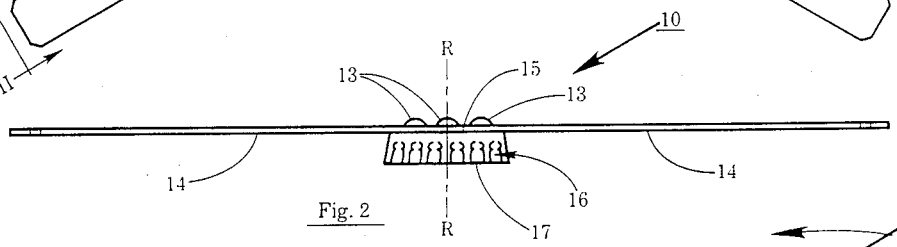
FIG. 2 is an elevation view of the device of FIG. 1.
Figure 3:
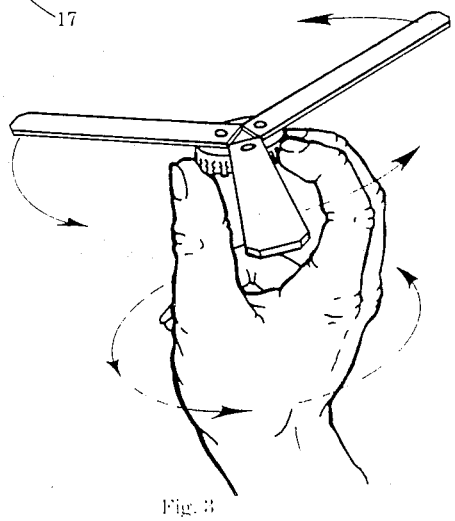
FIG. 3 is a perspective view showing the hand and wrist of an operator launching the device of FIGS. 1–2A.
Figure 7:
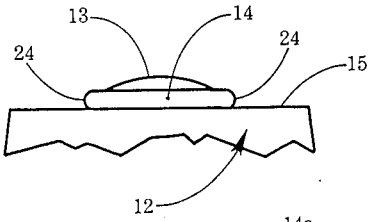
FIG.7 is a view taken along line VII—VII of FIG. 1, with portions of the hub broken away and two blades omitted for improved clarity of the illustration.

Referring to the drawings wherein like reference numerals refer to similar parts throughout, there is shown in FIGS. 1 and 2 the toy helicopter of this invention designated generally by the numeral 10. The toy 10 includes a central hub 12 from which extends radially three equiangular spaced blades 14. Although there is shown in FIGS. 1–3 as a preferred embodiment of this invention a toy 10 having three blades 14, it should be understood that any number of blades may be used, although generally two, three or four blades are most effective. One end of each blade 14 is affixed to the hub 12 and each blade 14 extends radially from the hub 12, the blades lying in a common plane as best seen in FIG. 2. Although the blades 14 may be sufficiently rigid that blades 14 lie in a flat plane as illustrated in FIG. 2, blades 14 may also be made to be somewhat more flexible so that they bow slightly of their own weight when the toy 12 is held horizontally, as illustrated in FIG. 2. Therefore, the common plane in which blades 14 lie may be flat or it may be slightly curved, i.e., slightly bowl-shaped. Flexible blades are safer and the device may readily be made of such light-weight and flexible materials that it is quite safe, even for use by young children. The lateral edges of the blades may be beveled as at 24 (FIGS. 7–7B) to help provide a smoother flight. Both lateral edges of each blade may be so beveled because the leading and trailing edges are reversed depending on the rotation direction imparted by the user or whether the user employs the left or right hand.

The blades 14 are joined to hub 12 by rivets 13 (or any other suitable means) which fasten a hub end of each blade 14 to a mounting portion 15 of hub 12. In the illustrated embodiment, mounting portion 15 is flat and lies in a transverse plane A—A (FIG. 2A) which extends transversely of the axis of rotation R—R (FIG. 2) of hub 12. The blades are preferably spaced equiangularly around the hub so that for a three-bladed device, such as that illustrated in FIG. 1, each blade is spaced apart at an angle of 120° from each other. A four-bladed equiangularly-spaced toy would have an angular space between blades of 90°. As used herein and in the claims, it is to be understood that the number of blades is counted by the number of blade elements extending radially from the hub. Thus, a single blade structure fastened at its midpoint to the hub 12 and extending radially of the hub in two opposite directions therefrom, would comprise two blades even if the blade is an integral, unitary member. It should also be understood that the term "hand-launched" as used herein and in the claims refers to a device which is launched directly by hand without the interposition of an intermediate mechanical device, such as the hand-operated rotating screw of the aforementioned Pickett U.S. Pat. No. 1,201,866.

A finger grip portion 16 of hub 12 extends axially from mounting portion 15 in the direction away from (below, as viewed in FIG. 2) the blades 14 and transverse plane A—A. The hub 12 is rotatable with finger grip portion 16, i.e., the latter is integral with, or may be non-rotatably affixed to, the hub 12. Where desired, the hub 12 and finger grip portion 16 may be fabricated or molded as an integral part. The finger grip portion 16 is substantially cylindrical in shape about the hub axis of rotation R—R, although, in the illustrated embodiment, hub 12 is shaped like a truncated cone so that the diameter of mounting portion 15 is somewhat less than that of hub 12 at its grip end 17. Typically, the axial length 1 (FIG. 2A) of the finger grip portion 16 (as measured along axis of rotation R—R) is at least about one-fourth its diameter d. Regardless of its size, however, the finger grip portion 16 is dimensioned and configured so that it can be easily and firmly grasped by an operator, most typically between the thumb and forefinger as illustrated in FIG. 3.

Figure 2A:
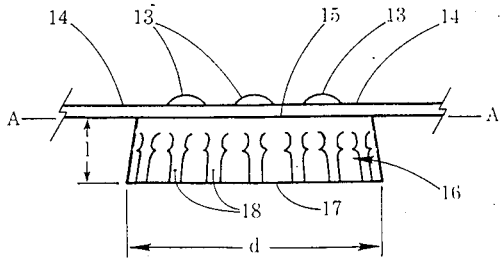
FIG. 2A is a view on an enlarged scale of the hub portion of the device of FIG. 2, with the blades broken away.
Figure 4A:
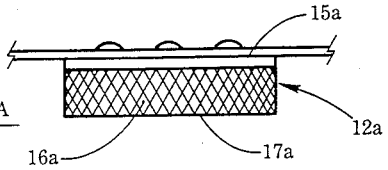
FIG. 4A, 4B, 4C and 4D are views, corresponding to that of FIG. 2A, of four other embodiments of the invention, with FIG. 4D shown in partial cross-section.
Figure 4B:
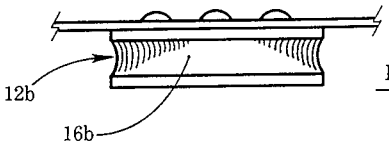
Figure 4C:
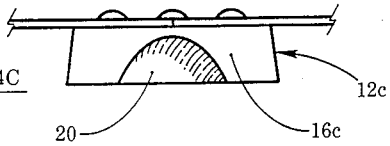
Figure 4D:
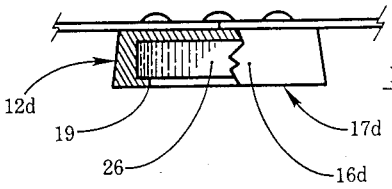

As shown in the drawings, e.g., FIGS. 2 and 2A, the finger grip portion 16 adjoins the blades 14 at the hub 12.

Where desired, the finger grip portion 16 may be roughly textured as by knurling to provide ridges or protuberances 18 (see FIG. 2A) in order to facilitate and assure a firm grasp by the operator. Other suitable variations in the design of finger grip portion 16 may, of course, be used. FIGS. 4A, 4B, 4C and 4D show such variations, each respectively comprising a hub **12*a*, 12*b*, 12*c* and 12*d* having a respective finger grip portion 16*a*, 16*b*, 16*c* and 16*d*. In FIG. 4A hub 12*a* is of regular circular cylindrical configuration, i.e., has the same diameter at its mounting portion 15*a* as it does at its grip end 17*a*. Finger grip portion 16*a* is scored to provide a knurled surface. In FIG. 4B, finger grip portion 16*b* of hub 12*b* is of concave construction, having a groove extending radially thereabout, to faciliate gripping finger grip portion 16*b* between thumb and forefinger. In FIG. 4C, finger grip portion 16*c* of hub 12*c* has a semicircular shaped recess 20 formed in it to receive the operator's thumb and thereby provide a better grip. A corresponding recess (not shown) may be formed in finger grip portion 16*c* radially opposite recess 20 to receive therein the tip of the operator's finger. The grip end 17*d* of the toy illustrated in FIG. 4D defines a circular rim 19 and the interior of hub 12*d* is hollow to receive therein a disc-shaped weight 26 which may be glued or otherwise fastened within hub 12*d* to ballast the toy. The circular rim 19 of grip end 17*d* may be flexible so that a suitably dimensioned and configured disc-shaped weight 26 may be snap-fitted into the hollow recess provided by hub 12*d***.

In operation, the finger grip portion **16–16*d* is grasped between the thumb and forefinger of the hand of the operator, and the toy is launched by a snap of the wrist coupled with a slight outward and forward movement of the arm, as illustrated in FIG. 3**. With a little practice, the operator will be able to launch the toy with a rotational (about axis of rotation R—R, FIG. 2A)

motion into a flight path which rises then falls and travels in a straight or curved line. The flight of the toy resembles that of a helicopter, and different flight characteristics may be imparted to it by different launching techniques which the operator learns by trial and error, including the velocity of launch, the degree of rotation imparted and the amount, direction and speed of arm movement combined with wrist rotation. With practice, the operator learns to launch the device in various modes. Specific launching techniques and configurations of the blades, the latter being described in more detail below, enable imparting different flight paths and characteristics to the device. For example, it may be launched in a circular flight path and so used like a boomerang, or in a straight flight path convenient for a game of catch between two or more players or for the objective of hitting or landing on a target.

Figure 5A:
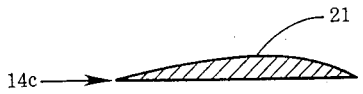
FIGS. 5A and 5B are transverse cross sections of two different embodiments of airfoil type blades useable as the blades of devices in accordance with this invention.
Figure 5B:
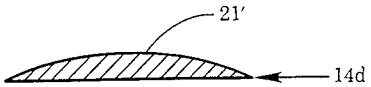
Figure 7A:
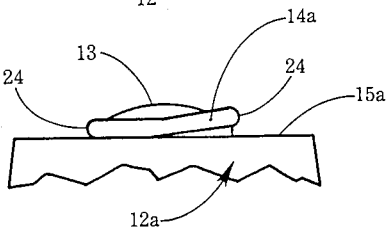
FIGS. 7A and 7B views, corresponding to FIG. 7, of other embodiments of the invention.
Figure 7B:
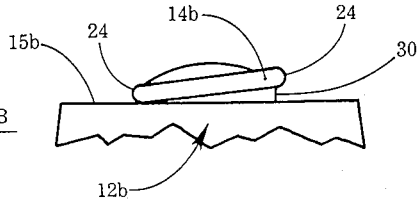
Figure 8:
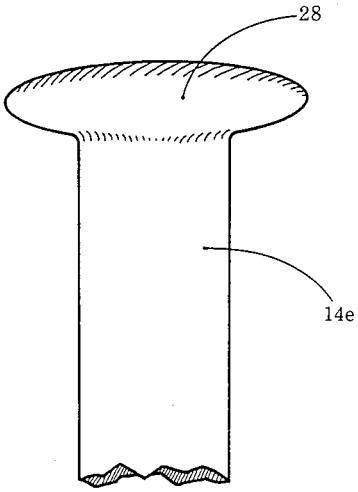
FIG. 8 is a top plan view of the tip portion of a blade in accordance with yet another embodiment of the invention.

Variations in blade design may be employed to enhance or vary flight characteristics of the device. For example, as shown in FIGS. 5A and 5B the blades 14*c* and 14*d* may be configured to comprise airfoils, e.g., to have respective upper surfaces 21 or 21' which are curved to provide enhanced lift to the blades 14*c*, 14*d* in flight. The cross-section views of FIGS. 5A and 5B are taken perpendicularly to the longitudinal axis of the blade. Another variation in blade design is shown in FIG. 8, in which the blade tips 28 are weighted, preferably by integrally molding a blade tip 28 of increased thickness and/or width as part of a blade 14*e* as illustrated. Further, the blade may be configured so that one of the lateral edges 24 of the blades provides a positive angle of attack as shown in FIG. 7A with respect to blade 14*a*. Of course, a negative angle of attack is provided by reversing the direction of launch or by tapering the leading lateral edge downwardly. The same effect may be attained by positioning a flat blade 14*b* in a tilted position (FIG. 7B) relative to the mounting portion 15*b* of the hub 12*b*. A wedge-shaped fastener means 30 may be used to secure the blade 14*b* in a tilted position. Generally, configuring the blades to provide a positive angle of attack, i.e., with the leading edge of blades being turned upwardly in the direction of rotation, provides better climb characteristics of the device whereas configuring the blades to provide a negative angle of attack, i.e., with the leading edge of the blade angled downwardly, provides a longer flight time.

Figure 6:
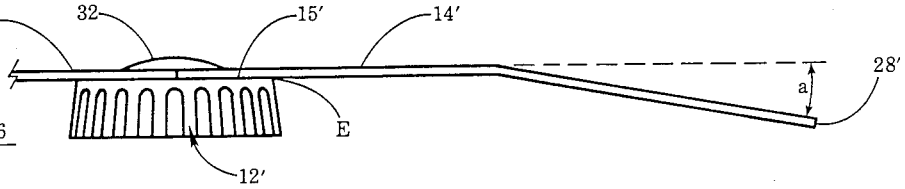
FIG. 6 is an elevation view, with a blade broken away, of yet another embodiment of the invention.

By bowing or bending the blades about an axis transverse to the longitudinal axis of the blades, a straighter flight path is obtained. For example, as shown in FIG. 6, each of the blades may be bent at any convenient place along the blade length, for example, at the midpoint of the blade (as measured between the peripheral edge E of the hub mounting portion 15' and the blade tip 28') or closer to the hub 12'. The blade may be bent, at an angle a of up to 20°, say at an angle between 5 and 20°, e.g., 10°. In the embodiment of FIG. 6, hub 12' carries blades 14' affixed thereto and has, over the hub-mounted ends of blades 14' a shallow, dome-shaped cover 32.

In the manufacture of the toy, all or some of the parts can be fabricated from plastic materials, that is, from synthetic organic polymeric materials such as cross-linked polyethylene, polyvinylchloride, or the like, or from a suitable wood such as balsa wood. The blades may be made of a material, such as a suitable vinyl plastic, which can be bowed or bent as described above and straightened by the user as desired, to enable the user to modify the blade configuration and hence the flight characteristics of the device. Such materials which, upon being bowed or bent, retain the configuration resulting from the bowing or bending, are referred to herein and in the claims as a "conformable" material. One particularly useful combination of materials is blades made of a plastic material and the hub, including its finger grip portion, made of metal. The blades of a rotary flight device may be fabricated as a unitary piece from one type of material, e.g., a plastic, and the hub and its finger grip portion may be fabricated as a unitary piece from another type of material, e.g., pressed from metal. The hub may thus be a stamped metal piece with a corrugated or pleated finger grip portion, very similar in construction to an ordinary pry-open type bottle cap. Alternatively, the toy may be fabricated as a unitary, integral body of one material such as a suitable plastic material. For a toy such as that illustrated in FIG. 1, having its blades fabricated from plastic and its hub from pressed metal, suitable dimensions include a span for each blade of approximately 4 to 8 inches, a hub of about 1 to 1¼ inches in diameter (d in FIG. 2A), and a finger grip portion having an axial length (1 IN FIG. 2A) of about 3/16 to ½ inches. Of course, any other suitable dimensions may be employed, as long as the device is conveniently sized for hand-launching.

While the invention has been described in detail with respect to specific preferred embodiments, it will be apparent to those skilled in the art that numerous variations and modifications may be made which nonetheless lie within the scope of the invention and the appended claims.

What is claimed is:

1. A hand-launched rotary flight device comprising:

(a) a central hub having an axis of rotation and comprising a finger grip portion;

(b) a plurality of spaced-apart blades joined to the hub at a blade-mounting portion thereof, and extending radially therefrom and terminating in respective blade tips; the hub being rotatable with the finger grip portion, the finger grip portion adjoining the blades at the hub and extending axially from the blade-mounting portion and being dimensioned and configured to enable manual gripping thereof between thumb and forefinger by the operator to impart to the device free-flight and rotary motion about the axis of rotation of the hub.

2. The rotary flight device of claim 1 wherein the blades are equiangularly spaced apart.

3. A rotary flight device comprising:

(a) a generally disc-shaped central hub having an axis of rotation and comprising a blade-mounting portion;

(b) a plurality of equiangularly spaced-apart blades joined to the blade-mounting portion of the hub, extending radially therefrom and terminating in respective blade tips;

the hub extending axially from its blade-mounting portion to provide a finger grip portion thereof which adjoins the blades at the hub and is dimensioned and configured to enable manual gripping thereof by an operator between thumb and forefinger to impart to the device free-flight and rotary motion about the axis of rotation of the hub.

4. The rotary flight device of claim 2 or claim 3 comprising three blades extending from the hub.

5. The rotary flight device of claim 1 or claim 3 wherein the finger grip portion has a knurled surface dimensioned and configured to be gripped by the operator between thumb and forefinger.

6. The rotary flight device of claim 1 or claim 3 wherein the finger grip portion is provided with a recess to accommodate the thumb of the operator.

7. The rotary flight device of claim 1 or claim 3 including a ballast weight carried by the hub.

8. The rotary flight device of claim 1 or claim 3 wherein at least the leading edge of each blade is beveled.

9. The rotary flight device of claim 1 or claim 3 wherein the blades are made of a conformable material whereby the blades may be selectively bowed or bent to a desired configuration.

10. The rotary flight device of claim 1 or claim 3 wherein the blades are bent about respective axes transverse to the longitudinal axes of the blades so as to displace the blade tips relative to the hub in the direction from the blade-mounting portion to the grip end portion.

11. The rotary flight device of claim 10 wherein the blades are bent to define a bend angle of up to about 20 degrees.

12. The rotary flight device of claim 11 where the bend angle is from about 5 to 20 degrees.

13. The rotary flight device of claim 1 or claim 3 wherein the blade tips are weighted.

14. The rotary flight device of claim 1 or claim 3 wherein the blades are configured to have a positive angle of attack.

15. The rotary flight device of claim 1 or claim 3 wherein the blades are configured to have a negative angle of attack.

16. The rotary flight device of claim 1 or claim 3 wherein the blades are configured to have a positive angle of attack in one direction of rotation and negative angle of attack in the opposite direction of rotation.

17. The rotary flight device of claim 1 or claim 3 wherein the blades are flat in cross section.

18. A hand-launched rotary flight device comprising:

(a) a central hub having an axis of rotation and comprising a finger grip portion;

(b) three equiangularly spaced-apart blades joined to the hub at a blade-mounting portion thereof, and extending radially therefrom and terminating in respective blade tips; the hub being rotatable with the finger grip portion, the finger grip portion extending axially from the blade-mounting portion and being dimensioned and configured to enable manual gripping thereof by the operator to impart to the device free-flight and rotary motion about the axis of rotation of the hub.

19. A rotary flight device comprising;

(a) a generally disc-shaped central hub having an axis of rotation and comprising a blade-mounting portion;

(b) three equiangularly spaced-apart blades joined to the blade-mounting portion of the hub, extending radially therefrom and terminating in respective blade tips; the hub extending axially from its blade-mounting portion to provide a finger grip portion thereof which has a knurled surface and is dimensioned and configured to enable manual gripping thereof by an operator to impart to the device free-flight and rotary motion about the axis of rotation of the hub.

20. A hand-launched rotary flight device comprising:

(a) a central hub having an axis of rotation and comprising a finger grip portion;

(b) a plurality of spaced-apart blades joined to the hub at a blade-mounting portion thereof, and extending radially therefrom and terminating in respective blade tips; the hub being rotatable with the finger grip portion, the finger grip portion (i) extending axially from the blade-mounting portion, (ii) having a recess formed in it to accommodate the thumb of the operator, and (iii) being dimensioned and configured to enable manual gripping thereof by the operator to impart to the device free-flight and rotary motion about the axis of rotation of the hub.

* * * * *